US006915770B2

(12) United States Patent
Lu

(10) Patent No.: US 6,915,770 B2
(45) Date of Patent: Jul. 12, 2005

(54) LUBRICATING OIL SUPPLYING STRUCTURE OF AN ENGINE

(76) Inventor: Chi-Fang Lu, No. 37, Lane 157, Sec. 8, Yanping N. Rd., Shrlin Chiu, Taipei (TW)

( * ) Notice: Subject to any disclaimer, the term of this patent is extended or adjusted under 35 U.S.C. 154(b) by 0 days.

(21) Appl. No.: 10/692,815

(22) Filed: Oct. 27, 2003

(65) Prior Publication Data

US 2005/0087161 A1 Apr. 28, 2005

(51) Int. Cl.[7] ..... F01M 1/04
(52) U.S. Cl. ..... 123/90.38; 123/196 R
(58) Field of Search ..... 123/196 R, 196 CP, 123/196 M, 90.38

(56) References Cited

U.S. PATENT DOCUMENTS 821,915 A * 5/1906 Altham ..... 123/196 CP
2,983,334 A * 5/1961 Dalrymple ..... 123/196 CP
5,072,699 A * 12/1991 Pien ..... 123/196 R
6,769,391 B1 * 8/2004 Lee et al. ..... 123/196 R
2003/0233993 A1 * 12/2003 Radel ..... 123/196 R

* cited by examiner

*Primary Examiner*—Andrew M. Dolinar
(74) *Attorney, Agent, or Firm*—Rosenberg, Klein & Lee

(57) ABSTRACT

An engine has a through hole and a fitting hole on a lower portion of a crankcase, an oil container under the crankcase, a conduit inserted in the fitting hole, and a check valve disposed over a lower end of the through hole; lubricating oil is contained in the container; the check valve will seal the through hole when subjected to an upward force, and will open when subjected to a downward force; thus, the lubricating oil can be drawn into the crankcase via the conduit during a return stroke of the piston, and oil in the crankcase will flow back into the container via the through hole during a forward stroke of the piston; the amount of the lubricating oil in the container is such that that hot lubricating oil that has just flown back into the container can be cooled down in the container before it is drawn out again.

3 Claims, 6 Drawing Sheets

LUBRICATING OIL SUPPLYING STRUCTURE OF AN ENGINE

BACKGROUND OF THE INVENTION

1. Field of the Invention

The present invention relates to a lubricating oil supplying structure of an engine, more particularly one, which can significantly reduce flow of lubricating oil into the combustion chamber so as to reduce incomplete combustion and soot discharge.

2. Brief Description of the Prior Art

Referring to FIGS. 5 and 6, a conventional engine 2 includes a cylinder 21, a piston 22 in the cylinder 21, a spark plug 25 connected with the cylinder 21 for igniting fuels in the cylinder 21 with, a crankshaft 24, a crankcase 26 secured to the cylinder 21, and a connecting rod 23 connected with both the piston 22 and the crankshaft 24 for allowing reciprocal linear movement of the piston 21 to effect rotary movement of the crankshaft 24; after the piston 22 is moved in the return stroke to compress gas mixed with fuels in the cylinder 21, the spark plug 25 will ignite the fuels, and in turns, the piston 22 is forced to move in the forward direction to provide power.

Lubricating oil is contained in the crankcase 26 so that the crankshaft 24, bearings for the crankshaft 24, and the piston 22 can be lubricated to move smoothly when the engine is working.

However, the above engine is found to have disadvantages as followings:

1. In case there is an excessive amount of lubricating oil in the crankcase 26, the lubricating oil will hinder smooth movement of the crankshaft 24, and some of the lubricating oil will be carried into the combustion chamber by the piston 22, and mixed with the fuels. Consequently, incomplete combustion happens, and combustion efficiency reduces, causing more carbon deposit in the combustion chamber and soot discharge of the engine.
2. The engine will become relatively hot quickly due to increase of friction between different parts thereof, and can't be effectively cooled in case there is no enough lubricating oil in the crankcase 26. Consequently, the engine will be subjected to damage and breakdown.

SUMMARY OF THE INVENTION

It is a main object of the present invention to provide a lubricating oil supplying structure of an engine to overcome the above disadvantages.

The present lubricating oil supplying structure of an engine includes a through hole formed on a lower portion of a crankcase, a fitting hole formed on the lower portion of the crankcase, a lubricating oil container disposed under, and fixedly connected to the crankcase, an oil conduit firmly inserted in the fitting hole for the oil container to communicate with the crankcase, and a check valve disposed over a lower end of the through hole. The crankcase has a first holding room receiving a crankshaft assembly therein, and a second holding room, in which a cam shaft assembly is received. The cam shaft assembly is operable with the crankshaft assembly for controlling a swing arm assembly of the engine. The oil container having lubricating oil contained therein. The check valve can seal the through hole lower end when subjected to an upward force, and is movable away from the through hole when subjected to a downward force. Thus, the lubricating oil can be drawn into the crankcase via the oil conduit during a return stroke of the piston, and lubricating oil in the crankcase can be pushed back into the container via the through hole during a forward stroke of the piston; there is enough amount of lubricating oil in the container so that hot lubricating oil will be cooled down in the container before it is drawn out for use again after flowing back into the container, and there won't be excessive lubricating oil to hinder operation of the parts in the crankcase because lubricating oil can flow back into the container.

BRIEF DESCRIPTION OF THE DRAWINGS

This invention will be better understood by referring to the accompanying drawings, wherein.

DETAILED DESCRIPTION OF THE PREFERRED EMBODIMENTS

Figure 1:
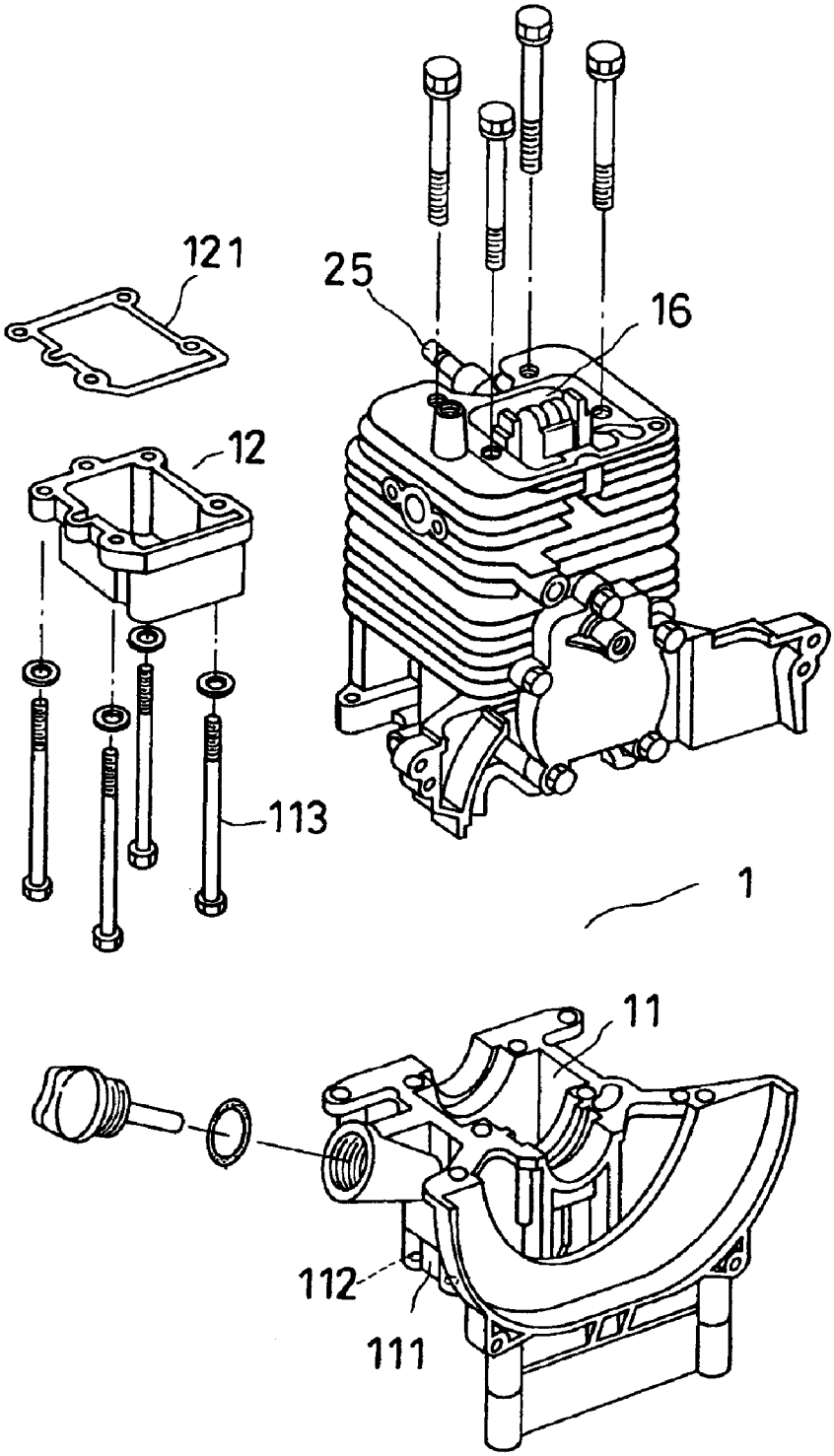
FIG. 1 is an exploded perspective view of an engine according to the present invention.
Figure 2:
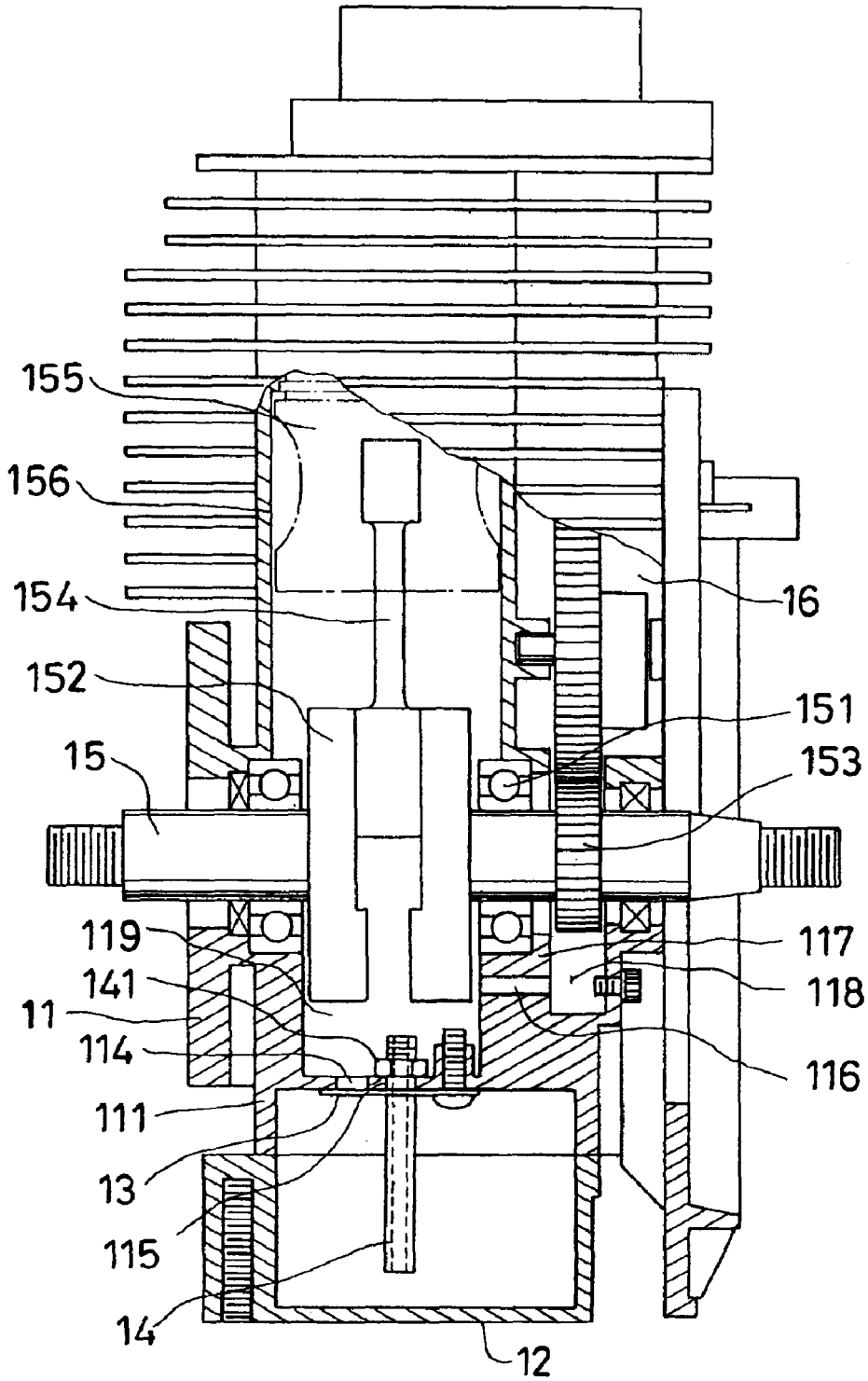
FIG. 2 is a cross-sectional view of the engine according to the present invention.
Figure 3:
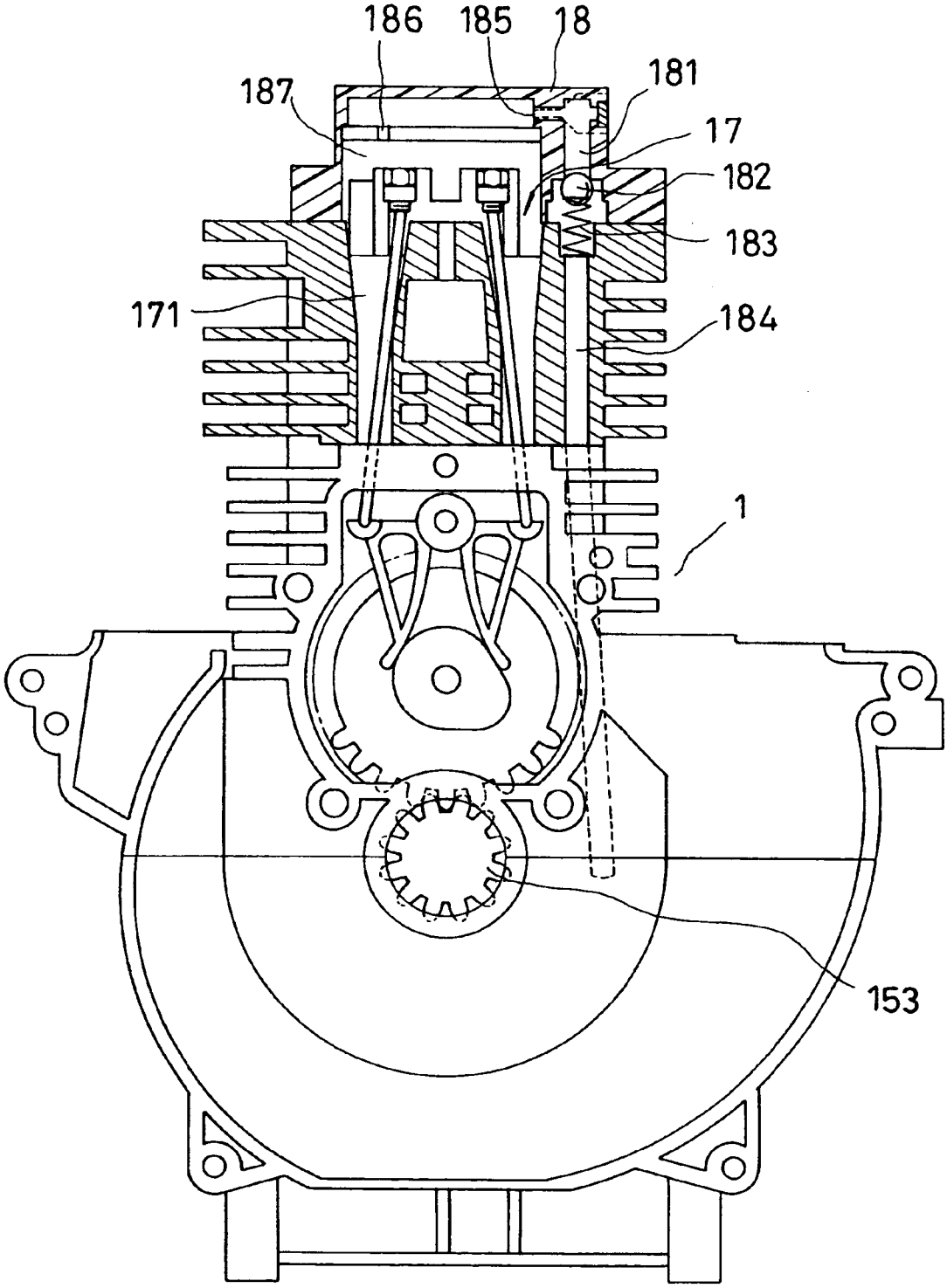
FIG. 3 is a view of the engine of the present invention in operation.

Referring to FIGS. 1 to 3, a preferred embodiment of an engine in the present invention includes:

- a crankcase 11 secured to a lower end of a cylinder 156 of the engine; the crankcase 11 has a through hole 114, and a fitting hole 115 on a lower side thereof, holding rooms 119, 118, a transverse hole 116 on a wall that separates the holding rooms 119 and 118, bearing stands 117 fixedly disposed therein, and a lower extension portion 111, which is formed with screw holes 112;
- a lubricating oil container 12 secured to the lower extension portion 111 of the crankcase 11 by means of screwing bolts 113 through the container 12 and into the screw holes 112; a leak-prevention pad 121 is disposed between the container 12 and the lower extension portion 111 of the crankcase 11 for preventing oil leakage; the container 12 is preferably 80% full in using the engine;
- an oil conduit 14 inserted in the fitting hole 115 of the crankcase 11, and secured in position with a nut 141 for allowing lubricating oil to travel from the container 12 into the crankcase 11 through it;
- a check valve 13 arranged under the through hole 114 so that lubricating oil is allowed to flow from the holding room 119 into the oil container 12 via the hole 114, and is prevented from flowing from the oil container 12 into the holding room 119 via the hole 114;
- a piston 155 in the cylinder 156;
- a spark plug 25 connected with the cylinder 156 for igniting fuels in the cylinder 156 with;
- a crankshaft assembly 15, the crankshaft assembly 15 includes a shaft part, two bearings 151 supported on the bearing stands 117 of the crankcase 11, a crank 152 connected with the shaft part, a gear connected with the shaft part, and a connecting rod 154 connected with both the crank 152 and the piston 155 for making reciprocal linear movement of the piston 155 effect rotary movement of the shaft part of the crankshaft assembly 15; the gear 153 is arranged in the holding room 118 to oppose the cam shaft case 16; thus, after the piston 155 is moved in the return stroke to compress gas mixed with fuels in the cylinder 156, the spark plug 25 will ignite the fuels, and in turns, the piston 155 is forced to move downwards (forward stroke) to provide power;

a cam shaft case 16 disposed in the holding room 118 of the crankcase 11, and a cam shaft assembly received in the cam shaft case 16; the cam shaft assembly including a second gear (not numbered) and a cam (not numbered) connected with the second gear to be rotary together therewith; the second gear is engaged with the gear 153; a swing arm assembly 17 is arranged on, and movable by the cam of the cam shaft assembly for controlling operation of the engine; and a cover 18 disposed over the swing arm assembly 17, as shown in FIG. 3, the cover 18 has a straight passage 184 communicating with the holding room 118 of the crankcase 11, an air hole 186, a through hole 181 communicating with the straight passage 184, and a transverse hole 185; the transverse hole 185 is formed between, and communicates with both the through hole 181 and the air hole 186; the air hole 186 of the cover 18 further communicates with a return flow chamber 187 and return flow holes 171 of the swing arm assembly 17 so that an air passage is formed because of the return flow chamber 187, and the holes 186, 185, and 181; a bead 182 is arranged between the through hole 181 and the straight passage 184, and biased upwards to abut a lower opening of the through hole 181 by a spring 183; the bead 182 will be forced to seal the lower opening of the through hole 181 owing to negative pressure formed in the second holding room 118 during a return stroke of the piston 155, and will be forced to move away from the through hole 181 owing to positive pressure formed in the second holding room 118 during a forward stroke of the piston 155.

Furthermore, the oil conduit 14 is located at the middle of the oil container 12 such that lubricating oil in the container 12 still can be supplied into the holding rooms 118 and 119 even if the engine is tilted up to 45 degrees.

Figure 4:
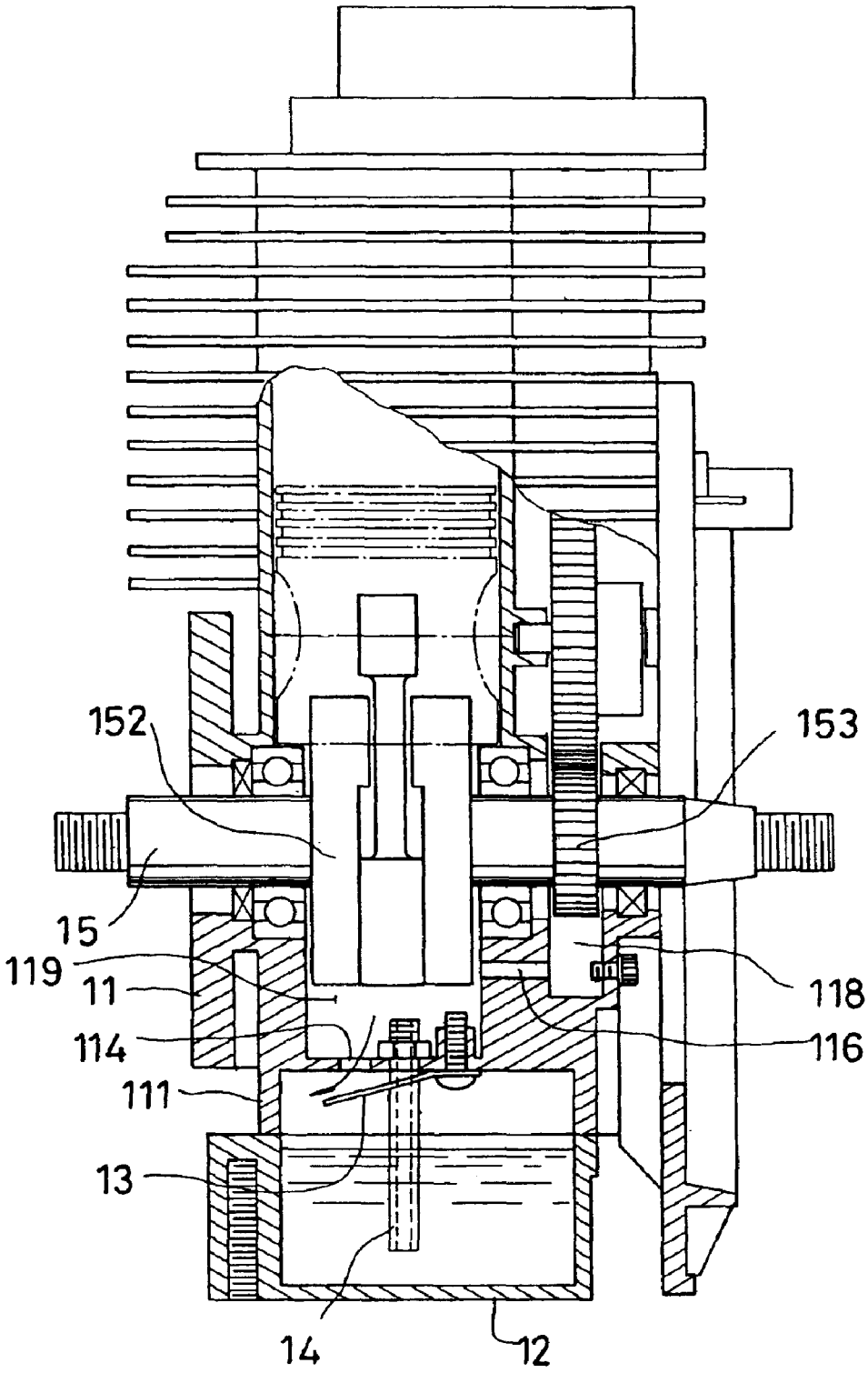
FIG. 4 is another cross-sectional view of the engine according to the present invention.
Figure 5:
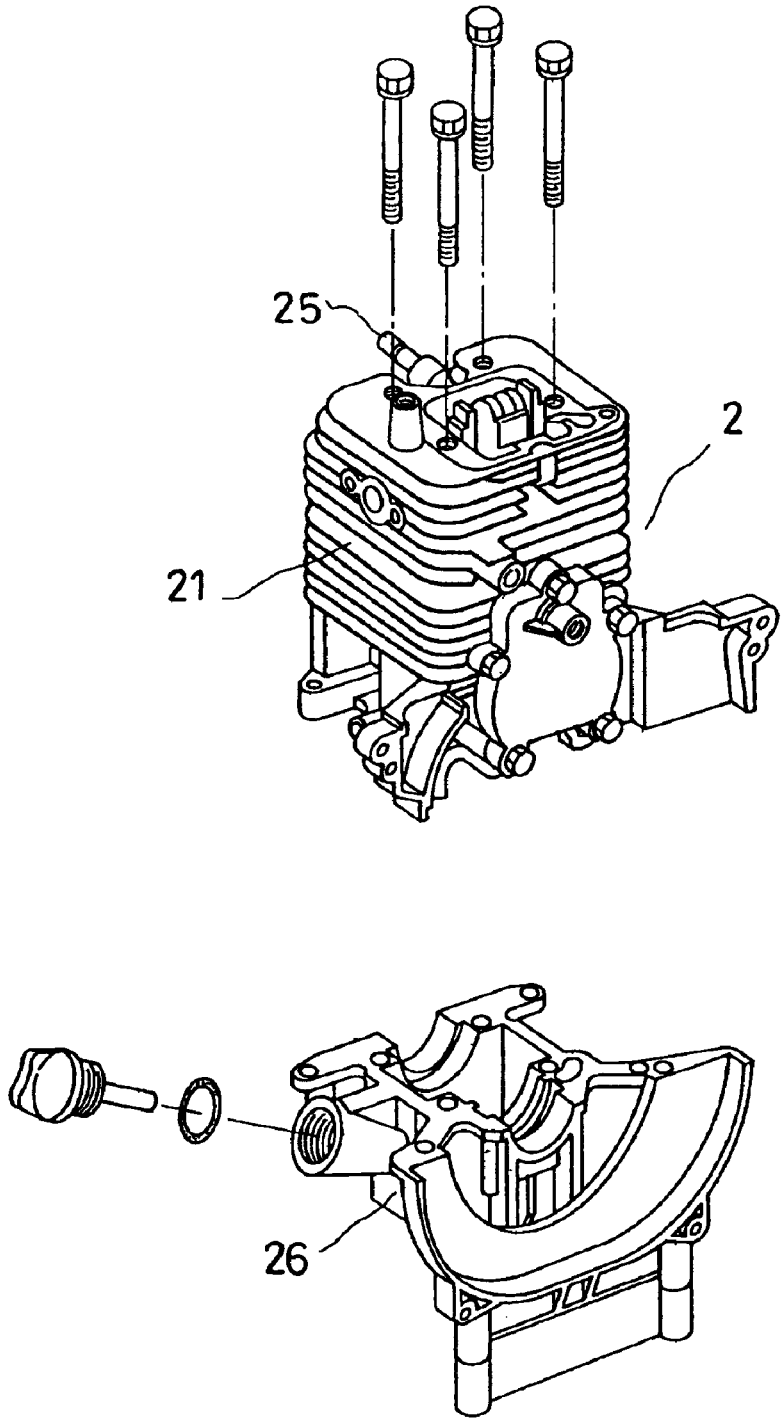
F I G. 5 (PRIOR ART)
FIG. 5 is an exploded perspective view of the conventional engine as described in the Background.
Figure 6:
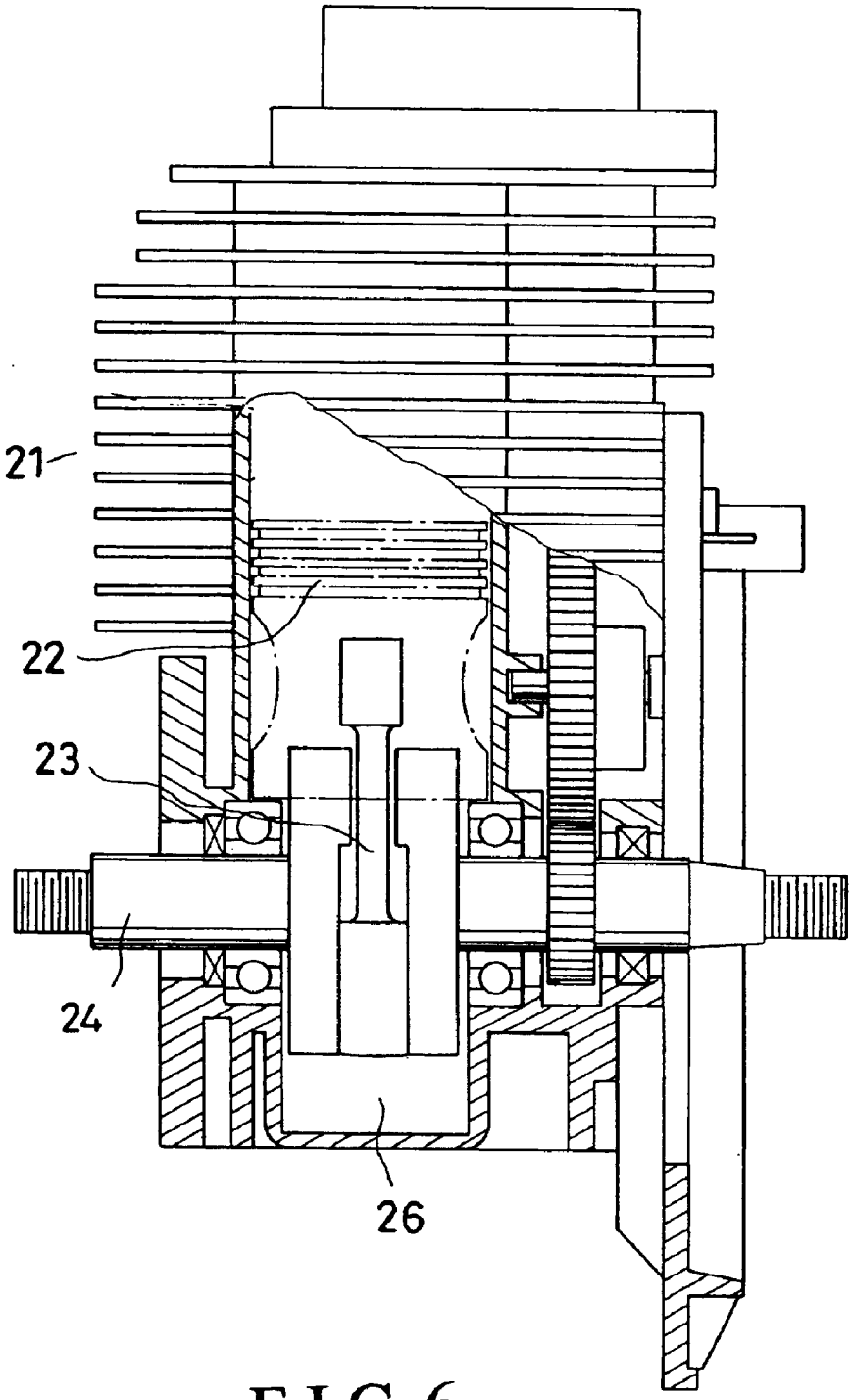
F I G. 6 (PRIOR ART)
FIG. 6 is a partial cross-sectional view of the conventional engine.

When the piston 155 is moved downwards (in the forward stroke) in operation of the engine, as shown in FIG. 4, increased pressure in the holding room 119 will open the check valve 13, and in turns, lubricating oil in the holding room 119 flows into the oil container 12. And, when the piston 155 is moved upwards (in the return stroke), as shown in FIG. 2, negative pressure will be formed in the holding room 119 owing to volume increase, and the check valve 13 close the through hole 114, and in turns, lubricating oil is drawn into the holding rooms 119, and 118 through the oil conduit 14, and the transverse bole 116 respectively, thus, the gear 153, the bearings 151, and bushings fitted on the crank 152 and the connecting rod 154 are lubricated. And, lubricating oil will flow into the oil container 12 during the next forward stroke of the piston 155. Lubricating oil will be made to become spray form to spread all over the holding room 119 by the rapid movement of the crank 152.

Thus, when the piston 155 is moved upwards (during the return stroke), gas in the return flow chamber 187 will be made to travel into the holding room 118 via both the through hole 181 and the straight passage 184. And, the gas will flow into the return flow chamber 187 via the return flow holes 171 during a forward stroke of the piston 155. Consequently, the gas will provide stabilizing pressure, and lubricating oil spray in the gas is provided to the swing arm assembly 17 to lubricate the same.

From the above description, it can be easily understood that the lubricating oil supplying structure of an engine of the present invention has advantages as followings:

1. An suitable amount of lubricating oil can be supplied into the holding rooms 118 and 119 to lubricate, and help cool down the gear 153, the crank 152, and the bearings 151 therefore there won't be excessive lubricating oil to hinder smooth operation of the crankshaft assembly 15, and there is less incomplete combustion, which will cause carbon deposit in the combustion chamber and soot discharge. Consequently, the engine can function normally and smoothly.
2. Because there is enough amount of lubricating oil in the container 12, hot lubricating oil that has just flown into the container 12 will be cooled down in the container 12 before it is drawn out for use again. When the piston 155 is moved upwards (in the return stroke), negative pressure will be formed in the crankcase 11, and lubricating oil in the return flow chamber 187 and the swing arm assembly 17 drawn back to the crankcase 11. And, because the oil conduit 14 is located at the middle of the oil container 12, lubricating oil still can be supplied into the holding rooms 118 and 119 even if the engine is tilted up to 45 degrees.

What is claimed is:

1. A lubricating oil supplying structure of an engine, comprising:

a through hole formed on a lower portion of a crankcase, which is secured to a cylinder of the engine, and which has a first holding room receiving a crankshaft assembly therein; a first gear being arranged in a second holding room of the crankcase, and connected with a shaft part of the crankshaft assembly; a cam shaft assembly being movable by the first gear for controlling a swing arm assembly of the engine; the cam shaft assembly being received in a cam shaft case disposed in the second holding room;

a fitting hole formed on the lower portion of the crankcase;

a lubricating oil container disposed under, and fixedly connected to the crankcase; the oil container having lubricating oil contained therein;

an oil conduit firmly inserted in the fitting hole for the oil container to communicate with the crankcase;

a check valve disposed over a lower end of the through hole; the check valve being capable of sealing the through hole lower end when subjected to an upward force; the check valve being movable away from the lower end of the through hole when subjected to a downward force;

whereby the lubricating oil is allowed to be drawn into the crankcase via the oil conduit when a piston of the engine is moving away from the crankshaft assembly during a return stroke, and lubricating oil in the crankcase is allowed to be pushed back into the container via the through hole when the piston is moving towards the crankshaft assembly during a forward stroke;

wherein a transverse hole is formed on the crankcase for the first holding room to communicate with the second holding room so that lubricating oil can be drawn into the second holding room via the transverse hole during a return stroke of the piston.

2. The lubricating oil supplying structure of an engine as claimed in claim 1, wherein the crankcase has a lower extension portion, which is formed with screw holes, while the oil container is secured to the lower extension portion of the crankcase by means of screwing bolts through the container and into the screw holes.

3. A lubricating oil supplying structure of an engine, comprising:

a transverse hole formed on a crankcase and communicating with both first and second holding rooms of the crankcase; the first holding room receiving a crankshaft assembly therein; a first gear being arranged in the second holding room of the crankcase, and connected with a shaft part of the crankshaft assembly; a cam shaft assembly being movable by the first gear for controlling a swing arm assembly of the engine; the cam shaft assembly being received in a cam shaft case disposed in the second holding room;

a cover disposed over the swing arm assembly; the cover having a straight passage communicating with the second holding room of the crankcase; the cover having an air hole communicating with both a return flow chamber and a return flow hole of the swing arm assembly; the cover having a through hole communicating with the straight passage; the cover having a transverse hole formed between, and communicating with both the through hole and the air hole;

a bead arranged between the through hole and the straight passage, and biased to abut an opening of the through hole by a spring; the bead being forced to seal the opening of the through hole owing to negative pressure formed in the second holding room during a return stroke of a piston of the engine; the bead being forced to move away from the opening of the through hole owing to positive pressure formed in the second holding room during a forward stroke of the piston;

whereby gas in the return flow chamber is allowed to be forced to travel into the second holding room via both the through hole and the straight passage during a return stroke of the engine, and gas is allowed to flow into the return flow chamber via the return flow hole during a forward stroke of the piston such that gas provides stabilizing pressure, and lubricating oil spray in the gas is provided to the swing arm assembly to lubricate same.

* * * * *